US006216932B1

(12) United States Patent
Wu

(10) Patent No.: US 6,216,932 B1
(45) Date of Patent: Apr. 17, 2001

(54) SUPPORT MEMBER AND DETACHABLE CONTAINER MOUNTING ARRANGEMENT

(76) Inventor: Bo Kun Wu, No. 391, Hsintu Rd., Tainan (TW)

( * ) Notice: Subject to any disclaimer, the term of this patent is extended or adjusted under 35 U.S.C. 154(b) by 0 days.

(21) Appl. No.: 09/434,571

(22) Filed: Nov. 4, 1999

(30) Foreign Application Priority Data

Jul. 15, 1999 (TW) ..... 88211833

(51) Int. Cl.[7] ..... A45C 15/00

(52) U.S. Cl. ..... 224/583; 224/581; 224/605; 224/647; 224/649; 224/271; 224/901.8

(58) Field of Search ..... 224/250, 259, 224/260, 269, 271, 578, 579, 581, 582, 583, 605, 620, 647, 648, 649, 901.2, 901.4, 901.6, 901.8

(56) References Cited

U.S. PATENT DOCUMENTS 37,893 * 3/1863 Baxter ..... 224/583 X
1,273,201 * 7/1918 Teuber ..... 224/583 X
3,717,188 * 2/1973 Green ..... 224/583 X
5,799,851 * 9/1998 Wulf et al. ..... 224/583

* cited by examiner

*Primary Examiner*—Stephen K. Cronin
(74) *Attorney, Agent, or Firm*—Pro-Techtor International Services

(57) ABSTRACT

A support member and detachable container mounting, which includes a support member, for example, a shoulder strap, a container having a top mounting hole, a flexible suspension member having one end fixedly connected to the support member and an opposite end terminating in a T-shaped end piece inserted through the mounting hole on the container by force to suspend the container from the support member, and loop and hook materials respectively provided at the support member and the T-shaped end piece of the flexible suspension member for enabling the T-shaped end piece of the flexible suspension member to be secured to the support member.

14 Claims, 4 Drawing Sheets

SUPPORT MEMBER AND DETACHABLE CONTAINER MOUNTING ARRANGEMENT

BACKGROUND OF THE INVENTION

The present invention relates to a support member and detachable container mounting arrangement, which enables a container, for example, a bag to be easily detachably fastened to a support member, for example, a shoulder strap.

When going outdoors for shopping or outdoor activities, people may carry small bags for keeping small personal items. However, it is not convenient to constantly hold a small bag with the hand. In order to keep the hands free, one may use a fastening device, for example, a belt to secure a small bag to the body for keeping small personal items.

SUMMARY OF THE INVENTION

According to the present invention, a flexible suspension member is suspended from a support member (which can be a shoulder strap, a bag, or a piece of cloth) for holding a container (which can be, for example, a bag). The flexible suspension member has one end fixedly connected to the support member, and an opposite end terminating in a T-shaped end piece inserted through a mounting hole on the container by force to suspend the container from the support member. Further, loop and hook materials are respectively provided at the support member and the T-shaped end piece of the flexible suspension member, for enabling the T-shaped end piece of the flexible suspension member to be secured to the support member.

DETAILED DESCRIPTION OF THE PREFERRED EMBODIMENT

Figure 1:
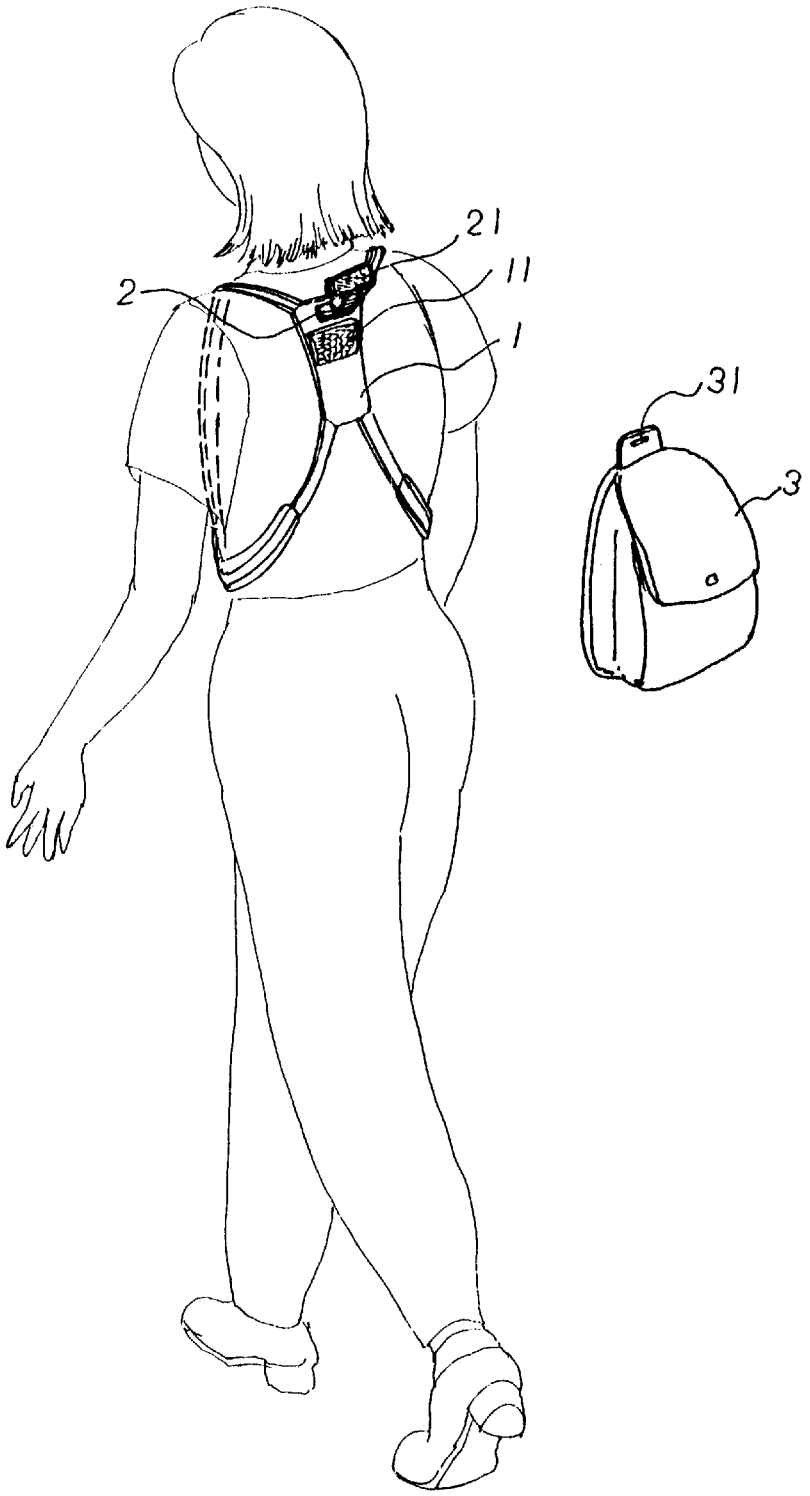
FIG. 1 is an exploded view of one embodiment of the present invention.
Figure 2:
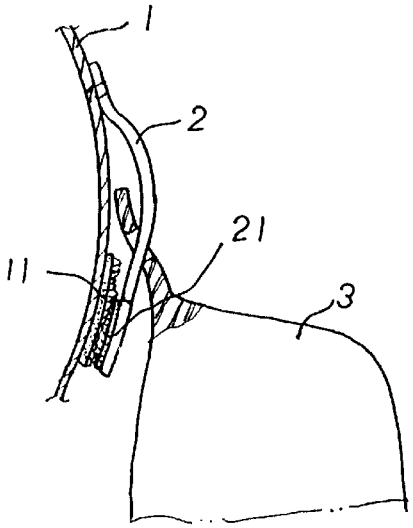
FIG. 2 is a sectional assembly view in an enlarged scale of a part of FIG. 1, showing the container suspended from the flexible suspension member, the free end of the flexible suspension member secured to the support member.

Referring to FIGS. 1 and 2, a support member and detachable container mounting arrangement in accordance with the present invention is shown comprising a support member (for example, a shoulder strap) 1, a pad of loop (or hook) material 11 fixedly provided at the support member 1, a flexible suspension member (for example, a strap) 2 suspended from the support member 1 outside the pad of loop material 11, the suspension member 2 having one end fixedly connected to the support member 1 and an opposite end terminating in a hook (or loop) material provided T-shaped end piece 21, and a container (for example, a bag) 3 detachably fastened to the support member 1 by the flexible suspension member 2. The container 3 has a mounting hole 31 on the topside thereof. The inner diameter of the mounting hole 31 is smaller than the T-shaped end piece 21.

Figure 3:
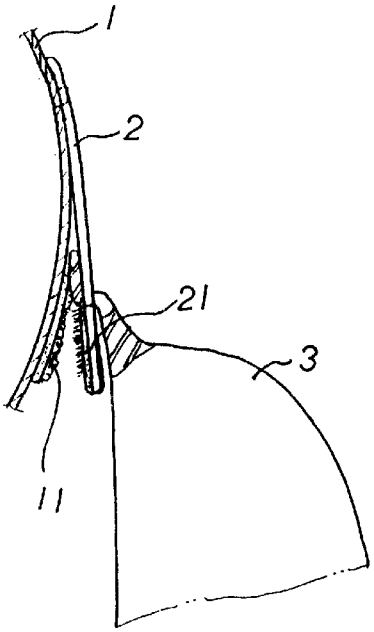
FIG. 3 is similar to FIG. 2 but showing the free end of the flexible suspension member disengaged from the support member.

Referring to FIG. 3 and FIGS. 1 and 2 again, by inserting the T-shaped end piece 21 of the flexible suspension member 2 through the mounting hole 31 by force, the container 3 is suspended from the flexible suspension member 2. After coupling of the mounting hole 31 of the container 3 to the flexible suspension member 2, the T-shaped end piece 21 is fastened to the pad of loop material 11 at the flexible suspension member 2. Because the T-shaped end piece 21 is provided with hook (or loop) material, it can be detachably fastened to the pad of loop material 11 at the flexible suspension member 2. Because the inner diameter of the mounting hole 31 is smaller than the T-shaped end piece 21, the mounting hole 31 of the container 3 is still maintained secured to the T-shaped end piece 21 of the flexible suspension member 2 in case the T-shaped end piece 21 is disengaged from the pad of loop material 11 at the flexible suspension member 2.

Figure 4:
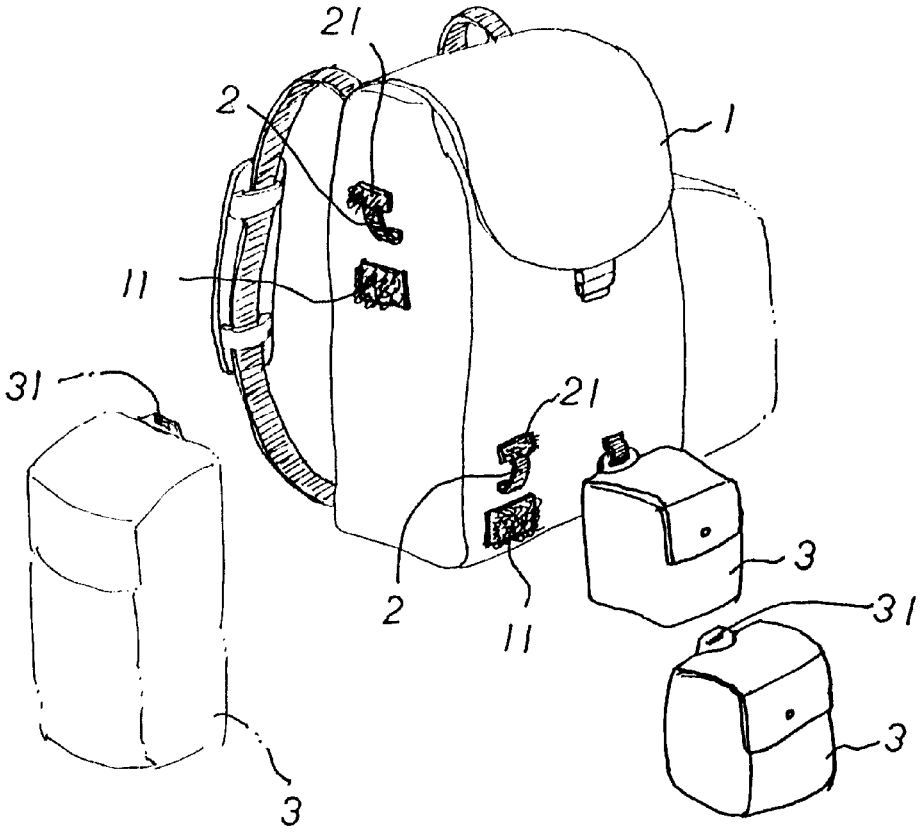
FIG. 4 shows another application example of the present invention.
Figure 5:
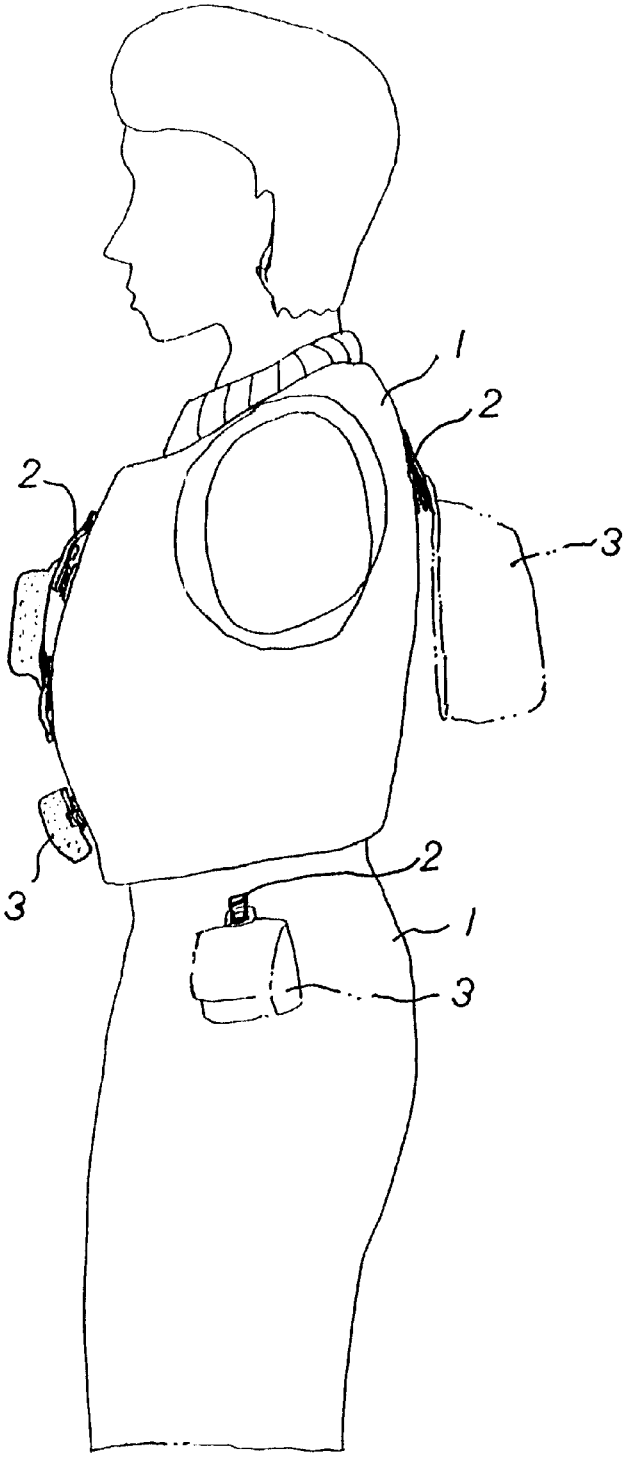
FIG. 5 shows still another application example of the present invention.

The aforesaid support member 1 can be a shoulder strap as shown in FIG. 1, a shoulder bag as shown in FIG. 4, a jacket or pairs of trousers as shown in FIG. 5. The aforesaid container 3 can be a handbag, pocket bag, etc.

It is to be understood that the drawings are designed for purposes of illustration only, and are not intended for use as a definition of the limits and scope of the invention disclosed. For example, the flexible suspension member 2 can have any of a variety of profiles; the free end (namely, the T-shaped end piece) of the flexible suspension member can be detachably fastened to the support member by a snap, or any of a variety of fasteners.

What the invention claimed is:

1. A support member and detachable container mounting arrangement comprising:

a support member;

a container having at least one mounting hole;

at least one flexible suspension member suspended from said support member for securing said container to said support member, said at least one flexible suspension member each comprising a first end fixedly fastened to said support member and a second end terminating in an expanded end piece and inserted through one mounting hole on said container;

a first fastening means fixedly mounted on said support member; and a second fastening means fixedly mounted on said expanded end piece of each of said at least one flexible suspension member for securing said expanded end piece of each of said at least one flexible suspension member to said fixed fastening means; wherein said expanded end piece of each of said at least one flexible suspension member has a width greater than a diameter of said at least one mounting hole on said container.

2. The support member and detachable container mounting arrangement of claim 1 wherein said first fastening means is a pad of loop material, and said second fastening means is a pad of hook material.

3. The support member and detachable container mounting arrangement or claim 1 wherein said first fastening means is a pad of hook material, and said second fastening means is a pad of loop material.

4. The support member and detachable container mounting arrangement of claim 1 wherein said support member is a shoulder strap.

5. The support member and detachable container mounting arrangement of claim 1 wherein said support member is a bag.

6. The support member and detachable container mounting arrangement of claim 1 wherein said support member is a piece of cloth.

7. The support member and detachable container mounting arrangement of claim 1 wherein said container is a bag.

8. A support member and detachable container mounting arrangement comprising:

a support member;

a container having at least one mounting hole;

at least one flexible suspension member suspended from said support member for securing said container to said support member, said at least one flexible suspension member each comprising a first end fixedly fastened to said support member and a second end terminating in an expanded end piece and inserted through one mounting hole on said container;

a first fastening means fixedly mounted on said support member; and a second fastening means fixedly mounted on said expanded end piece of each of said at least one flexible suspension member for securing said expanded end piece of each of said at least one flexible suspension member to said fixed fastening means; wherein said expanded end piece of each of said at least one flexible suspension member has a T-shaped profile.

9. The support member and detachable container mounting arrangement of claim 8 wherein said first fastening means is a pad of loop material, and said second fastening means is a pad of hook material.

10. The support member and detachable container mounting arrangement or claim 8 wherein said first fastening means is a pad of hook material, and said second fastening means is a pad of loop material.

11. The support member and detachable container mounting arrangement of claim 8 wherein said support member is a shoulder strap.

12. The support member and detachable container mounting arrangement of claim 8 wherein said support member is a bag.

13. The support member and detachable container mounting arrangement of claim 8 wherein said support member is a piece of cloth.

14. The support member and detachable container mounting arrangement of claim 8 wherein said container is a bag.

* * * * *